US007545328B2

(12) United States Patent
Son et al.

(10) Patent No.: US 7,545,328 B2
(45) Date of Patent: Jun. 9, 2009

(54) ANTENNA USING INDUCTIVELY COUPLED FEEDING METHOD, RFID TAG USING THE SAME AND ANTENNA IMPEDANCE MATCHING METHOD THEREOF

(75) Inventors: Hae-Won Son, Daejeon (KR); Won-Kyu Choi, Gyeonggi-do (KR); Je-Hoon Yun, Daejeon (KR); Cheol-Sig Pyo, Daejeon (KR); Jong-Suk Chae, Daejeon (KR)

(73) Assignee: Electronics and Telecommunications Research Institute (KR)

( * ) Notice: Subject to any disclaimer, the term of this patent is extended or adjusted under 35 U.S.C. 154(b) by 280 days.

(21) Appl. No.: 11/297,256

(22) Filed: Dec. 7, 2005

(65) Prior Publication Data

US 2006/0158380 A1 Jul. 20, 2006

(30) Foreign Application Priority Data

Dec. 8, 2004 (KR) ..... 10-2004-0103025
Apr. 15, 2005 (KR) ..... 10-2005-0031363

(51) Int. Cl.
*H01Q 1/38* (2006.01)

(52) U.S. Cl. ..... 343/700 MS

(58) Field of Classification Search ..... 343/700 MS, 343/748, 728, 867, 895; 455/82; 342/368
See application file for complete search history.

(56) References Cited

U.S. PATENT DOCUMENTS 3,747,114 A * 7/1973 Shyhalla ..... 343/795
4,229,746 A * 10/1980 Charlton ..... 342/368
6,028,564 A 2/2000 Duan et al.
6,097,347 A 8/2000 Duan et al.
6,133,891 A * 10/2000 Josypenko ..... 343/895
6,285,342 B1 9/2001 Brady et al.
6,342,868 B1 * 1/2002 Tsai et al. ..... 343/795
6,366,260 B1 4/2002 Carrender
6,417,816 B2 7/2002 Sadler et al.
6,424,311 B1 * 7/2002 Tsai et al. ..... 343/795
6,535,175 B2 3/2003 Brady et al.
7,057,574 B2 * 6/2006 Shamir et al. ..... 343/866
7,061,440 B2 * 6/2006 Choo et al. ..... 343/728
7,138,954 B2 * 11/2006 Schillmeier et al. ..... 343/795
7,154,449 B2 * 12/2006 Liu et al. ..... 343/867
7,317,901 B2 * 1/2008 Navsariwala et al. ..... 455/82

FOREIGN PATENT DOCUMENTS

WO WO 03096478 11/2003

* cited by examiner

*Primary Examiner*—Huedung Mancuso
(74) *Attorney, Agent, or Firm*—Blakely, Sokoloff, Taylor & Zafman

(57) ABSTRACT

Provided are an antenna using an inductively coupled feeding method, a Radio Frequency Identification (RFID) tag thereof, and an antenna impedance matching method thereof. The antenna includes a resonator for determining a resonance frequency of the antenna and a feeder for providing an RF signal to an element connected to the antenna. An RFID tag includes an antenna which receives an RF signal from the RFID reader, an RF front-end which rectifies and detects the RF signal, and a signal processor which is connected to the RF front-end. Particularly, the antenna includes a resonator for determining a resonance frequency of an antenna and a feeder for providing the RF signal to the RF front-end, wherein mutual inductive coupling between the resonator and the feeder is performed.

29 Claims, 6 Drawing Sheets

ANTENNA USING INDUCTIVELY COUPLED FEEDING METHOD, RFID TAG USING THE SAME AND ANTENNA IMPEDANCE MATCHING METHOD THEREOF

FIELD OF THE INVENTION

The present invention relates to an antenna, a Radio Frequency Identification (RFID) tag using the same and an antenna impedance matching method; and, more particularly, to an antenna using an inductively coupled feeding method, an RFID tag equipped with the antenna and an antenna impedance matching method.

DESCRIPTION OF RELATED ART

A Radio Frequency Identification (RFID) tag is used in diverse fields such as materials management and security together with an RFID reader. Generally, when an object with the RFID tag is put in a read zone of the RFID reader, the RFID reader transmits an interrogation signal to the RFID tag by modulating an RF signal having a specific carrier frequency and the RFID tag responses to the interrogation of the RFID reader. That is, the RFID reader transmits an interrogation signal to the RFID tag by modulating a continuous electromagnetic wave having a specific frequency, and the RFID tag transmits back the electromagnetic wave transmitted from the RFID reader to the reader after performing back-scattering modulation in order to transmit its own information stored in an inside memory. The back-scattering modulation is a method for transmitting tag information by modulating a size or phase of a scattered electromagnetic wave when the RFID tag transmits back the electromagnetic wave, which is transmitted from the RFID reader, back to the RFID reader by scattering the electromagnetic wave.

A passive RFID tag without an RF transmitter rectifies the electromagnetic wave transmitted from the RFID reader and uses the rectified electromagnetic wave as its own power source to acquire operation power. Intensity of electromagnetic wave transmitted from the RFID reader in a position of the tag should be larger than a specific threshold level for normal operation of the passive tag. That is, the read zone is limited by the intensity of the electromagnetic wave which is transmitted from the RFID reader and arrives at the tag. However, since the transmission power of the reader is limited by local regulation of each country including the Federal Communication Commission (FCC) of the U.S.A., it is not possible to unconditionally raise the level of transmission power. Therefore, the RFID tag should efficiently receive the electromagnetic wave transmitted from the RFID reader to extend the read zone without raising the transmission power level of the reader.

A method for raising the intensity of the RFID tag is to use a separate matching circuit. Generally, the RFID tag includes an antenna, an RF front-end and a signal processor. The RF front-end and the signal processor are manufactured as one chip. A method using the matching circuit is to maximize intensity of a signal transmitted from an antenna to an RF front-end by conjugation matching of the antenna and the RF front-end through a separate matching circuit. However, since the matching circuit formed by the combination of a capacitor and an inductor requires a large area in a chip, it is difficult to insert the matching circuit to the inside of a chip in the respect of miniaturization and costs.

SUMMARY OF THE INVENTION

It is, therefore, an object of the present invention to provide an antenna which is small, light, inexpensive and capable of an effective matching to a radio frequency (RF) front-end.

Also, the present invention is to provide a small and highly-efficient antenna having both resonant characteristic and broadband characteristic while occupying a small area by applying a meander structure to both ends of a trapezoid dipole structure.

Also, it is an object of the present invention to provide a Radio Frequency Identification (RFID) tag having the antenna.

Also, it is an object of the present invention to provide a method for matching an impedance of the antenna.

In accordance with an aspect of the present invention, there is provided an antenna including a resonator for determining a resonance frequency of the antenna and a feeder for providing an RF signal to an element connected to the antenna.

Preferably, the feeder has a loop structure that a terminal connecting to the element is formed. The resonator and the feeder can be fabricated on the same side of one substrate, different sides of one substrate, or each side of two substrates.

Preferably, the middle part of the resonator has a trapezoid flat dipole structure and both ends of the resonator have a meander structure.

In accordance with another aspect of the present invention, there is provided an RFID tag including an antenna which receives an RF signal from an RFID reader, an RF front-end which rectifies and detects the RF signal, and a signal processor which is connected to the RF front-end. Particularly, the antenna includes a resonator for determining a resonance frequency of an antenna and a feeder for providing the RF signal to the RF front-end, wherein, mutual inductive coupling between the resonator and the feeder is performed.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and advantages of the present invention will become apparent from the following description of the embodiments with reference to the accompanying drawings. Therefore, those skilled in the art that the present invention is included can embody the technological concept and scope of the invention easily. In addition, if it is considered that detailed description on the prior art may blur the points of the present invention, the detailed description will not be provided herein. The preferred embodiments of the present invention will be described in detail hereinafter with reference to the attached drawings.

Figure 1:
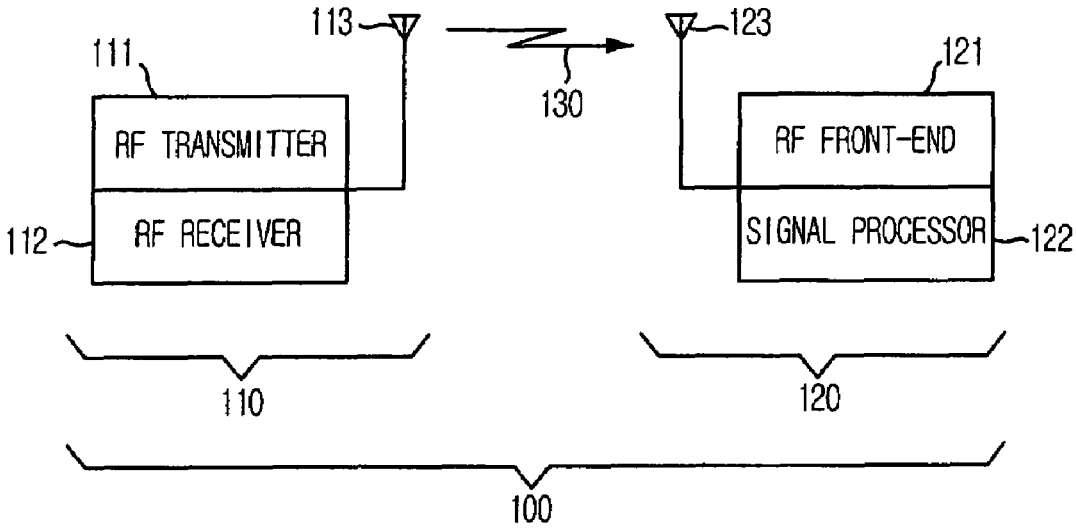
FIG. 1 is a block diagram showing a Radio Frequency Identification (RFID) system to which the present invention is applied.

FIG. 1 is a block diagram showing a Radio Frequency Identification (RFID) system to which the present invention is applied.

The RFID system 100 includes an RFID tag 120 for storing unique information, an RFID reader 110 having reading and decoding functions, and a host computer (not shown in FIG. 1) for processing data read from the RFID tag 120 through the RFID reader 110.

The RFID reader 110 can have a certain formation which is known to those skilled in the art. The RFID reader 110 includes an RF transmitter 111, an RF receiver 112 and a reader antenna 113. The reader antenna 113 is electrically connected to the RF transmitter 111 and the RF receiver 112. The RFID reader 110 transmits an RF signal to the RFID tag 120 through the RF transmitter 111 and the reader antenna 113. Also, the RFID reader 110 receives the RF signal from the RFID tag 120 through the reader antenna 113 and the RF receiver 112. Since a formation of the RFID reader 110 is well known to those skilled in the art, as suggested in U.S. Pat. No. 4,656,463, the detailed description will not be provided herein.

The RFID tag 120 includes an RF front-end 121, a signal processor 122 and a tag antenna 123 of the present invention. The RF front-end 121 can have a certain form, which is well known to those skilled in the art. In case of a passive RFID tag, the RF front-end 121 transforms the transmitted RF signal into direct current voltage and supplies power required for operating the signal processor 122. Also, the RF front-end 121 extracts a baseband signal from the transmitted RF signal. As suggested in the U.S. Pat. No. 6,028,564, the formation of the RF front-end 121 is well known to those skilled in the art, the detailed description will not be provided herein. The signal processor 122 can also have a certain formation, which is well known to those skilled in the art, as suggested in the U.S. Pat. No. 5,942.987.

In an operation of the RFID system 100, the RFID reader 110 transmits an interrogation to the RFID tag 120 by modulating an RF signal having a specific carrier frequency. The RF signal generated in the RF transmitter 111 of the RFID reader 110 is transmitted to the outside as a form of an electromagnetic wave through the reader antenna 113. An electromagnetic wave 130 transmitted to the outside is transmitted to the tag antenna 123 and the tag antenna 123 using the inductively coupled feeding method of the present invention transmits the received electromagnetic wave to an RF front-end 121. When the size of the RF signal transmitted to the RF front-end 121 is larger than minimum power level requested for operating the RFID tag 120, the RFID tag 120 responses to the interrogation of the RFID reader 110 by back-scattering modulation of the electromagnetic wave 130 transmitted from the RFID reader 110.

Herein, the intensity of the electromagnetic wave 130 transmitted from the RFID reader 110 should be large enough to provide operation power requested by the RFID tag 120 in order to enlarge the read zone of the RFID reader 110. Also, the electromagnetic wave 130 should be transmitted to the RF front-end 121 without damage by using the highly efficient tag antenna 123. The tag antenna 123 should have a resonant characteristic in a carrier frequency of the RFID reader 110 and complete conjugation matching with the RF front-end 121 in order to have high efficiency.

Figure 2:
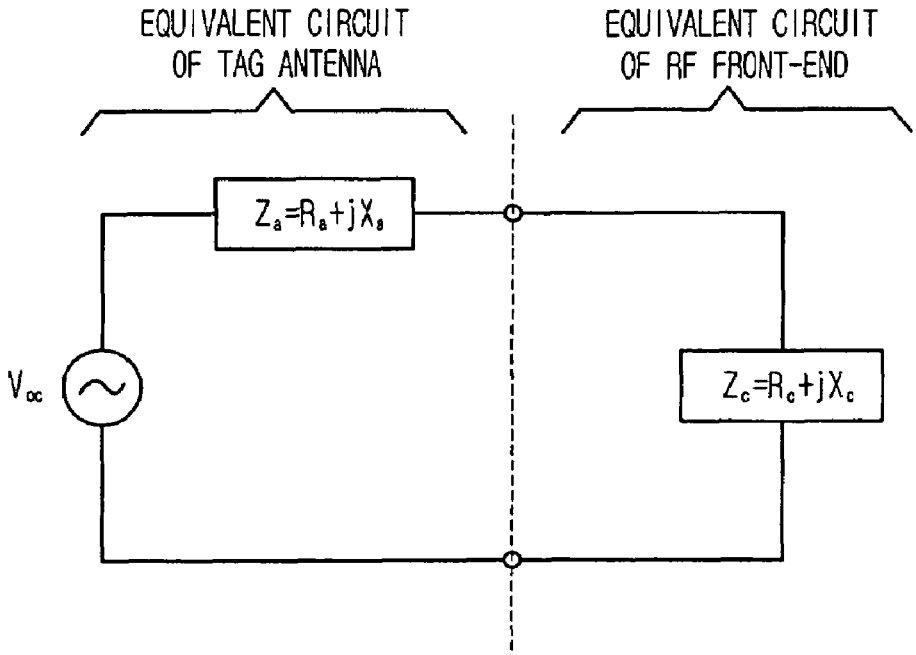
FIG. 2 shows a circuit modeling a tag antenna and an RF front-end.

FIG. 2 shows a circuit modeling a tag antenna and an RF front-end. A circuit includes a power source $V_{oc}$, an antenna impedance $Z_a$, and an RF front-end impedance $Z_c$. The power source $V_{oc}$ and the antenna impedance $Z_a$ are equivalent circuits of the tag antenna 123, and the RF front-end impedance $Z_c$ is an equivalent circuit of the RF front-end 121. The antenna impedance $Z_a$ has a real number part $R_a$ and an imaginary number part $X_a$. The real number part $R_a$ means an equivalent resistance of the tag antenna 123 and the imaginary number part $X_a$ means an equivalent reactance of the tag antenna 123. The RF front-end impedance also has a real number part $R_c$ and an imaginary number part $X_c$. The real number part $R_c$ means an equivalent resistance of the RF front-end 121 and the imaginary number part $X_c$ means an equivalent reactance of the RF front-end 121.

Generally, when conjugate matching between the antenna impedance $Z_a$ and the RF front-end impedance $Z_c$ is performed, maximum power is transmitted from the tag antenna 123 to the RF front-end 121. The conjugate matching is two complex impedances having same absolute values of the impedances and phases of different signs. That is, when the impedance of the tag antenna 123 or the impedance of the RF front-end 121 is controlled to complete $R_a=R_c$ and $X_a=-X_c$, maximum power is transmitted from the tag antenna 123 to the RF front-end 121.

Generally, the RF front-end 121 of a passive RFID tag includes rectification and detection circuits using a diode. Also, the RF front-end 121 of the passive RFID tag has a small resistance element $R_c$ of several Ω to tens of Ω, a large capacitive reactance $X_c$ of hundreds of Ω and a high quality factor, which is higher than 10. Therefore, an antenna impedance $Z_a$ for conjugate matching should have small resistance elements $R_a$ of several Ω to tens of Ω and a reactance $X_a$ of large, and simultaneously resonates according to a frequency of the electromagnetic wave. The RFID tag antenna of the present invention is efficiently matched to the RF front-end by controlling the antennal impedance to have a large inductive reactance in comparison with a resistance by an inductively coupled feeding method.

Figure 3:
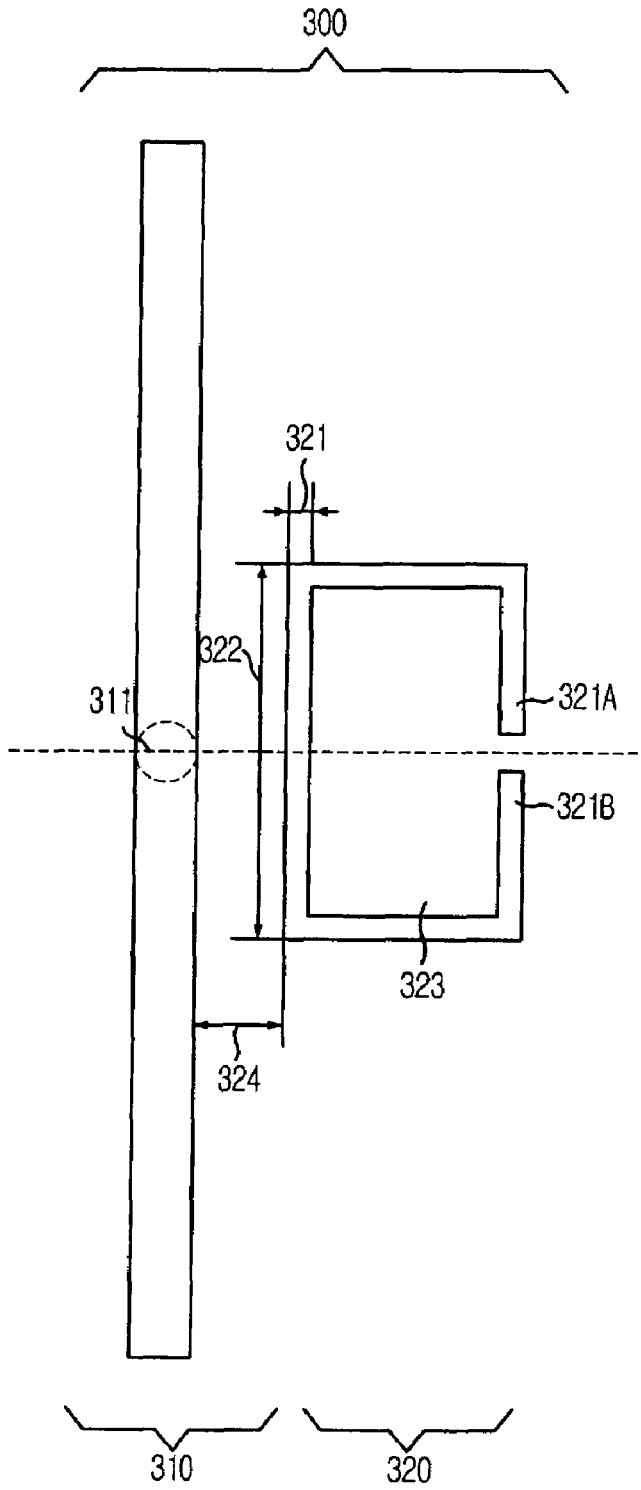
FIG. 3 is a block diagram of a tag antenna using inductively coupled feeding method in accordance with an embodiment of the present invention.

FIG. 3 is a block diagram of a tag antenna using inductively coupled feeding method in accordance with an embodiment of the present invention.

The tag antenna 300 includes a resonator 310 and a feeder 320. The resonator 310 has a half-wave dipole structure based on a feeding point 311, which is a position where the resonator 310 is coupled with the feeder 320. The feeder 320 includes a rectangular loop, and the RF front-end 121 is connected to both ends 321A and 321B of the feeder.

The resonance frequency of the resonator 310 determines a resonance frequency of the entire tag antenna 300. Also, a structure of the resonator 310 is a main factor for determining a real number part $R_a$ of the impedance in the tag antenna 300. The resonator 310 and the feeder 320 are inductively coupled with each other and the inductive coupling plays a role as an impedance transformer. That is, the impedance of the resonator 310 including a radiation resistance is shown in the both ends 321A and 321B of the feeder 320 as impedance transformed through the inductive coupling. The half-wave dipole impedance of about 73Ω in the feeding point 311 is transmitted to the feeder 320 after impedance transformation through inductive coupling, which is the same with an impedance transformation principle through a transformer widely used in a low frequency band.

Figure 4:
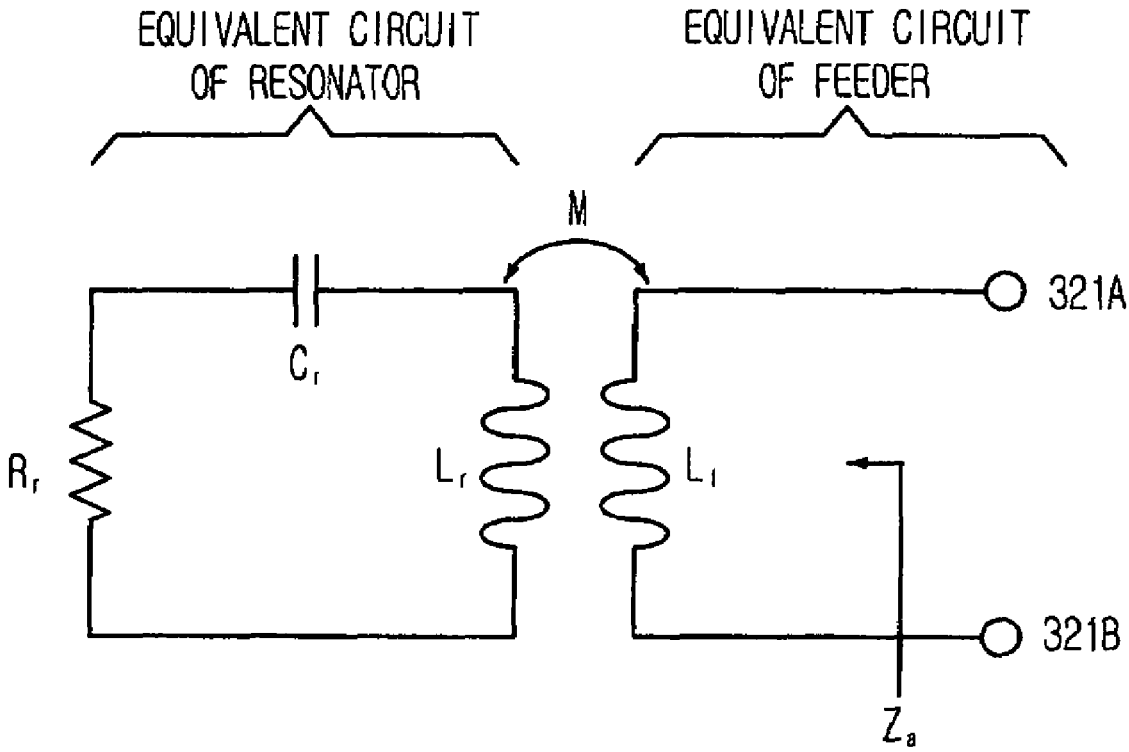
FIG. 4 is a circuit modeling the tag antenna of FIG. 3.

FIG. 4 is a circuit modeling the tag antenna 300 of FIG. 3. The circuit includes an impedance $Z_r$ of the resonator 310, an impedance $Z_j$ of the feeder 320 and a transformer having a mutual inductance M.

The impedance $Z_r$ of the resonator 310 and the impedance $Z_j$ of the feeder 320 are individually expressed as equations 1 and 2.

$$Z_r=R_r+j\omega L_r+1/(j\omega C_r) \quad \text{Eq. 1}$$

where $R_r$,$C_r$,$L_r$ corresponds to a resistance, a capacitance and a self inductance of an equivalent circuit of resonator 310, respectively, and ω is an operation frequency of the tag antenna 300.

$$Z_j=j\omega L_j \quad \text{Eq. 2}$$

where $L_j$ is a value of the self inductance of the equivalent circuit of the feeder 320.

The impedance $Z_r$ of the resonator 310 can be expressed as equation 3 by using a quality factor Q and a resonance frequency $\omega_o$ of the resonator.

$$Z_r=R_r+jR_rQ(\omega/\omega_o-\omega_o/\omega)=R_r(1+ju) \quad \text{Eq. 3}$$

where $\omega_o=1/\sqrt{L_rC_r}$, $Q=\omega_oL_r/R_r$ and $u=Q(\omega/\omega_o-\omega_o/\omega)$.

An input impedance of the tag antenna 300 seen in the both ends 321A and 321B of the feeder 320 is expressed as equation 4.

$$Z_a=R_a+jX_a=Z_j+\omega^2M^2/Z_r \quad \text{Eq. 4}$$

As shown in the equation 4, the impedance $Z_r$ of the resonator 310 is an impedance $\omega^2M^2/Z_r$ transformed through inductive coupling and can be seen in the both ends 321A and 321B of the feeder 320. The real number part $R_a$ and the imaginary number part $X_a$ of the antenna impedance $Z_a$ can be expressed as equations 5 and 6, respectively.

$$R_a=(\omega M)^2/R_r(1+u^2) \quad \text{Eq. 5}$$

$$X_a=\omega L_j-(\omega M)^2/R_r\,u/1+u^2 \quad \text{Eq. 6}$$

In the equation 5, when the tag antenna 300 resonates, which means $w=w_o$ or u=O, the real number part $R_a$ of the antenna impedance can be adjusted by controlling the real number part $R_r$ of the resonant impedance and the mutual inductance M between the resonator 310 and the feeder 320.

In the equation 6, when the tag antenna 300 resonates, which means $w=w_o$ or u=O, the imaginary number part $X_a$ of the antenna impedance can be adjusted by controlling a self inductance $L_j$ of the loop of the feeder 320. That is, in the equation 6, a second term on a right side of the equality sign becomes a zero based on u=O in a resonance frequency. Thus, since the imaginary number part $X_a$ of the antenna impedance is affected by only the self inductance $L_j$ of the feeder 320, the real number part $R_a$ can be controlled independently from the imaginary number part $X_a$ by constantly maintaining the self inductance $L_j$ of the feeder 320 and controlling the mutual inductance M between the resonator 310 and the feeder 320.

Meanwhile, in the equation 6, a first term on a right side has a positive inclination as a frequency w increases, and a second term has a negative inclination as a frequency w increases around a resonance frequency $\omega_o$. Therefore, the imaginary number part $X_a$, which is a value adding the two terms, has a relatively smaller inclination since the inclination of the two terms is offset in the around of the resonance frequency. Since the variation of the entire antenna impedance by variation of the frequency can be smaller by using the antenna feeding structure of the present invention, the present invention can change an impedance matching between the tan antenna 123 and the RF front-end 121 as a broadband.

As described above, the antenna impedance $Z_a$ is determined by geometrical forms, dimensions and mutual positions of the resonator 310 and the feeder 320. That is, the real number part $R_a$ and the imaginary number part $X_a$ of the antenna impedance can be determined by the mutual inductance M and the self inductance $L_j$ of the feeder 320, respectively.

In FIG. 3, the rectangular loop of the feeder 320 is characterized by a linewidth 321 of the loop, an internal area 323 of the loop, a height 322 of the loop side close to the resonator 310 and a distance 324 between the resonator 310 and the loop. The linewidth 321 and the internal area 323 of the loop mainly determine the self inductance $L_j$ of the loop. Also, the height 322 of the loop side close to the resonator 310 and the distance 324 between the resonator 310 and the loop determines the mutual inductance M between the resonator 310 and the feeder 320.

Therefore, when the height 322 of the loop side close to the resonator 310 or the distance 324 between the resonator 310 and the loop is varied while maintaining the linewidth 321 of the loop and the internal area 323, the mutual inductance M can be controlled without much variation of the self inductance $L_j$ of the loop, thereby increasing/decreasing the real number part $R_a$ without much variation of the imaginary number part $X_a$ of the antenna impedance. When the height 322 of the loop side close to the resonator 310 increases or when the distance 324 between the resonator 310 and the loop decreases, the mutual inductance M increases and the real number part $R_a$ of the antenna impedance increases. Conversely, when the height 322 of the loop side close to the resonator 310 decreases or when the distance 324 between the resonator 310 and the loop increases, the mutual inductance M decreases and the real number part $R_a$ of the antenna impedance decreases.

Meanwhile, when the linewidth 321 or the internal area 323 of the loop is varied while maintaining the height 322 of the loop side close to the resonator 310, and the distance 324 between the resonator 310 and the loop, the self inductance $L_j$ of the loop can be controlled without large variation of mutual inductance M, thereby increasing/decreasing the imaginary number part $X_a$ without large variation of the real number part $R_a$ of the antenna impedance. When the linewidth 321 of the loop decreases or the internal area 323 of the loop increases, the self inductance $L_j$ of the loop increases. Accordingly the imaginary number part $X_a$ of the antenna impedance increases. On the other hand, when the linewidth 321 of the loop increases or the internal area 323 of the loop decreases, the self inductance $L_j$ of the loop decreases. Accordingly, the imaginary number part $X_a$ of the antenna impedance decreases.

In FIG. 3, the resonator 310 has a half wave dipole structure based on the feeder 311. However, the resonator 310 can apply a certain antenna structure, which is well known to those skilled in the art of the present invention, such as folded dipole, loop and meander structures. Generally, the RFID tag is used by being attached to a certain object. Herein, since the resonance frequency of the resonator 310 is affected by the structure and an electrical characteristic of an object to have a tag attached thereto as well as the resonator 310 itself, this should be taken into consideration into designing of a resonator. Meanwhile, in FIG. 3, it is possible to control the antenna impedance $Z_a$ by inductively coupling diverse impedances $Z_r$ of the resonator 310 according to the variance of the feeder 311 by varying the feeder 311, which is a coupling position of the feeder 320 and the resonator 310. That is, although the feeding point 311 is positioned in the center of the resonator 310 in FIG. 3, it is not necessary that the feeding point 311 is positioned in the center of the resonator 310, and the resonator impedance $Z_r$ based on the position of the feeding point 311 can be reflected in the antenna impedance $Z_a$ by impedance transformation.

In FIG. 3, the feeder 320 has a form of a rectangular loop. The feeder 320 can apply a polygon loop, which includes a rectangular loop, a triangle loop and a square loop, and a curve loop, which includes a circle loop. When the feeder 320 is the polygon loop or the curve loop, it is apparent to those skilled in the art that it is possible to control an imaginary number part of the antenna impedance by controlling the self inductance of the feeder 320 according to the variance of the linewidth or the inside area of the loop, and control a real number part of the antenna impedance by controlling the mutual inductance according to the variance of height of a loop side close to the resonator or a distance between the resonator and the loop.

When the loop resonates around a resonance frequency of the resonator 310 due to the large size of the loop, it is very difficult to independently control the real number part $R_a$ and the imaginary number part $X_a$ of the antenna impedance $Z_a$. Therefore, it is preferable that a retrenchment circumference of the loop is 30% smaller than a wavelength corresponding to a resonance frequency of the resonator 310.

When the tag antenna 300 of the present invention is manufactured, inductive thin film of less than 0.1 mm is formed on a substrate. Hard materials such as glass, ceramic, teflon, epoxy and FR4, or thin and flexible organic materials such as polyimide, paper and plastic can be used as materials for the substrate. The resonance frequency of the antenna can be varied according to the electrical characteristic and thickness of the substrate, which should be reflected in designing of the antenna. Copper, copper alloy, aluminum and inductive ink are used as inductive materials, and an antenna pattern of the inductive material is formed on the substrate through an etching, deposition or print methods. The resonator 310 and the feeder 320 can be manufactured by using inductive material different to each other or in methods different to each other.

Herein, in the tag antenna 300 of the present invention, the resonator 310 and the feeder 320 are open in a Direct Current (DC) method. Therefore, the resonator 310 and the feeder 320 can be formed on the same side of one substrate, and one substrate can be individually formed on different sides. Also, the resonator 310 and the feeder 320 are individually formed on different substrates and integrated by controlling the positions of the resonator 310 and the feeder 320. Accordingly, the tag antenna 300 can be formed.

For example, when an RFID tag is attached to a paper box for wrapping a product, the resonator 310 is manufactured by being printed on a paper box with an inductive ink and the feeder 320 is individually manufactured by using an etching method. Subsequently, the tag antenna 300 can be formed by attaching the feeder 320 around the resonator printed on the paper box. Herein, the feeder 320 is individually manufactured by standardizing the form of the feeder 320, and can be used by integrating the feeder 320 with the resonator 310 designed and manufactured in diverse forms according to application fields. Since the feeder 320 standardized regardless of the entire form of the antenna 300 can be independently manufactured, it is possible to unite an inlay process of the RFID tag chip and the antenna 300, which is a process connecting the RFID tag chip to the antenna 300, and it is also possible to reduce the costs for manufacturing a tag.

Figure 5:
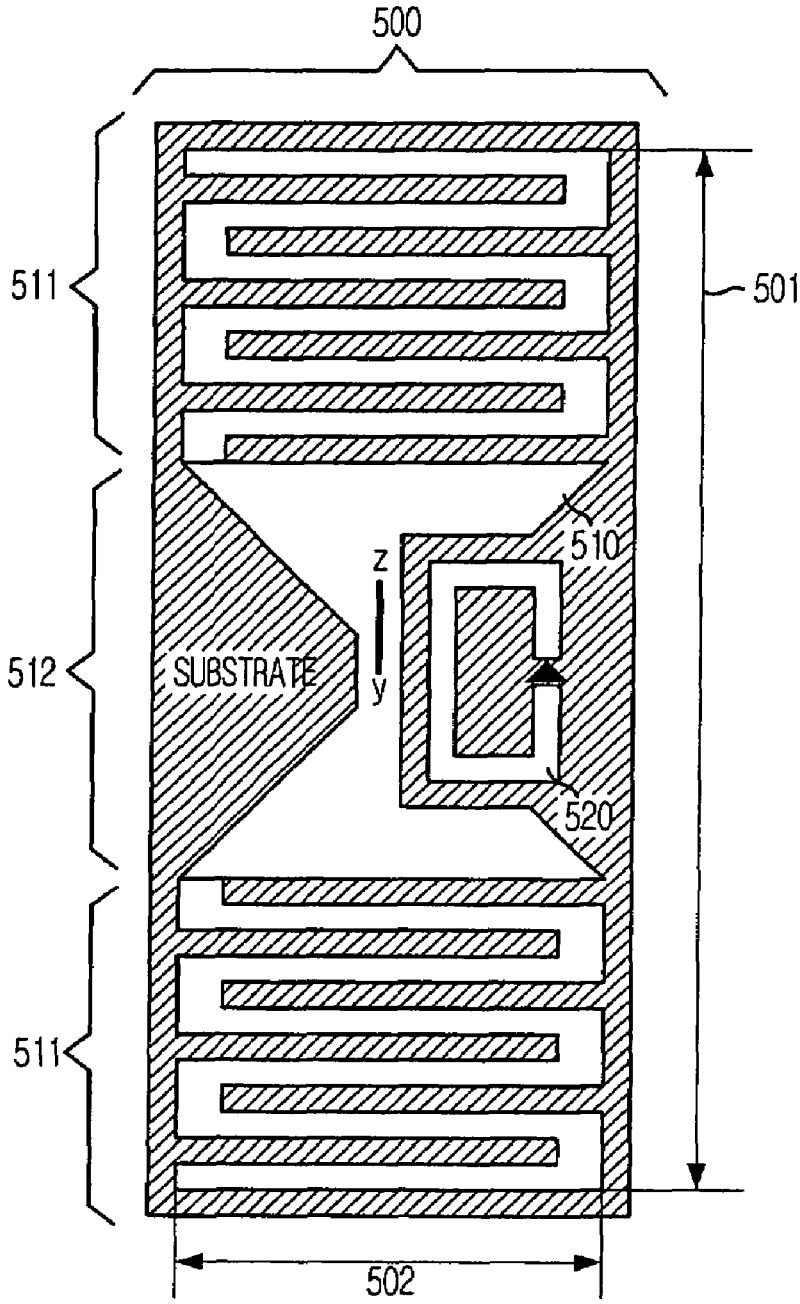
FIG. 5 is a diagram describing the tag antenna in accordance with another embodiment of the present invention.

FIG. 5 is a diagram describing the tag antenna in accordance with another embodiment of the present invention. The tag antenna 500 includes a resonator 510 and a feeder 520. The resonator 510 has a form that a meander structure is applied to both ends of a trapezoid flat dipole structure, which is different from a conventional antenna structure. When the entire antenna is designed in the meander structure by simply using a line of narrow width, an electrical effective height of the antenna increases, whereas a bandwidth of the antenna decreases. In the resonator of the present invention, a middle part 512 has a trapezoid structure and both ends have a meander structure to solve the above problems. Since the trapezoid flat dipole antenna has a broadband characteristic, it possible to compensate the shortcoming of the meander structure. Meanwhile, the feeder 520 of the tag antenna 500 has a form of rectangular loop.

Figure 6A:
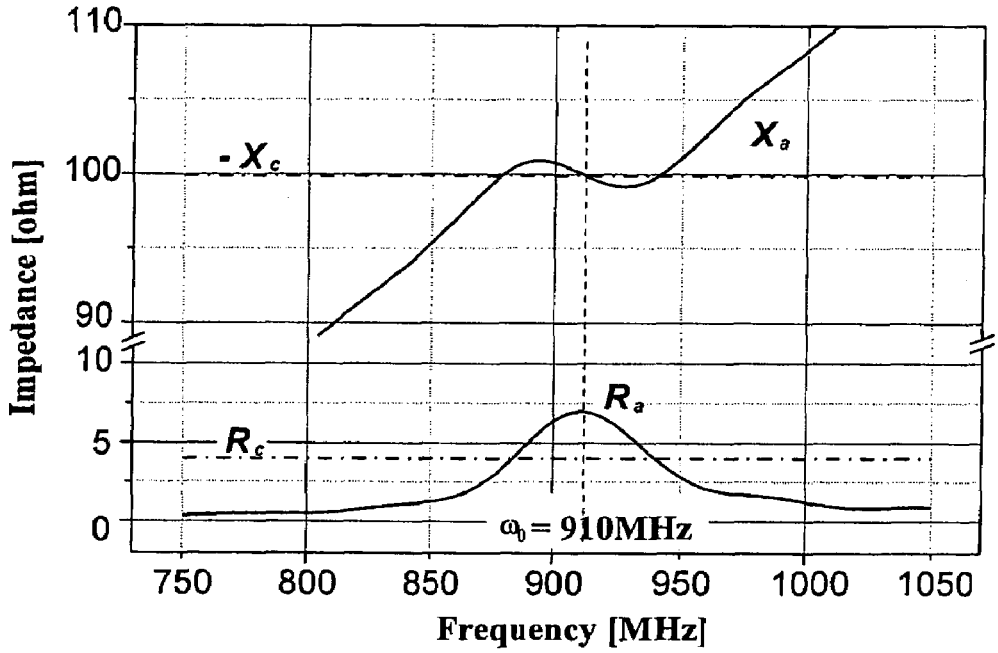
FIG. 6A is a graph showing antenna input impedance variation of the tag antenna shown in FIG. 5 according to the variation of a frequency.

FIG. 6A is a graph showing antenna input impedance variation of the tag antenna shown in FIG. 5 according to the variation of a frequency. As shown in the drawing, the real number part $R_a$ and the imaginary number part $X_a$ of the antenna input impedance have a symmetrical structure based on a resonance frequency $w_o$ individually. In particular, the imaginary number part $X_a$ has a maximum point and a minimum point, in which a code of an impedance inclination is varied as a frequency increases in boundary areas in the front and rear parts of the resonance frequency $w_o$. This is a typical form of an impedance in an broadband antenna. An impedance $Z_c$=4−j100 of the RF front-end 121 of the RFID tag is also expressed in FIG. 6A. It is apparent that conjugate matching is well performed around the resonance frequency $w_o$ of the tag antenna 500.

Figure 6B:
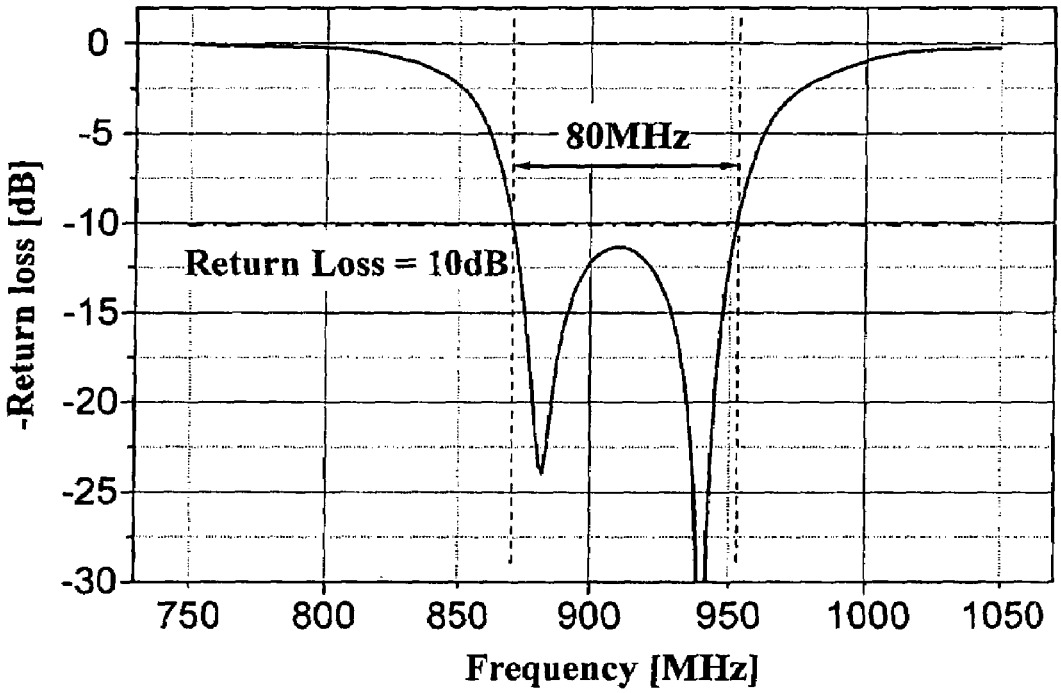
FIG. 6B is a graph showing a return loss between the tag antenna and the RF front-end result of FIG. 6A.

FIG. 6B is a graph showing a return loss between the tag antenna and the RF front-end result of FIG. 6A.

When a return loss larger than 10 dB is a standard, the tag antenna 500 has a wide impedance bandwidth, which is larger than 80 MHz in the front and rear parts of center frequency 910 MHz. The tag antenna 500 used in a simulated experiment has a height 501 of 7 cm and a width 502 of 2.4 cm. A substrate is polyethylene terephthalate (PET) having a relative dielectric constant of 3.2 and a thickness of 0.1 mm. When the antenna has the above specification, it is very difficult to have a bandwidth larger than 50 MHz by using a conventional antenna designing method. However, as shown in FIG. 6B, using the tag antenna 500 of the feeding structure of the present invention makes it possible to perform an effective broadband matching to the RF front-end 121 having impedance of larger capacity reactance in comparison with resistance. The tag antenna 500 used in FIG. 6B has a loop outer circumference of 15 mm×7.2 mm and a linewidth of 1.5 mm, and a distance between loop and a resonator is 1.5 mm.

The present invention makes it possible to effectively match the tag antenna to the RF front-end having an input impedance with a larger capacity reactance in comparison with resistance by using the inductively coupled feeding method. Also, it is possible to manufacture a small, light and inexpensive antenna through matching based on the inductively coupled feeding method of the present invention. Also, in the present invention, a small and highly efficient tag antenna can be realized since the resonator of the tag antenna increases the effective length and simultaneously has a broadband characteristic by having a meander structure in both ends of a trapezoid flat dipole structure.

The present application contains subject matter related to Korean patent application Nos. 2004-0103025 and 2005-0031363 filed with the Korean Intellectual Property Office on Dec. 8, 2004, and Apr. 15, 2005, respectively, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. An antenna, comprising:

a resonator for determining a resonance frequency of the antenna; and a feeder for providing a radio frequency (RF) signal to an element connected to the antenna, wherein the resonator has a dipole structure with opposed first and second ends, a first meander structure coupled to the first end, and a second meander structure coupled to the second end, wherein the feeder has a loop structure that a terminal, connected to the element, is formed onto, and at least a distance between the dipole structure of the resonator and the loop structure of the feeder is varied to control a real number part of the antenna impedance, and wherein a internal circumference of the loop is less than 30% of a wavelength corresponding to a resonance frequency of the resonator.

2. The antenna as recited in c1aim 1, wherein the feeder is controlled based on a characteristic that an imaginary number part of an impedance is varied according to a linewidth of the loop.

3. The antenna as recited in claim 2, wherein the impedance is controlled based on a characteristic that the imaginary number part increases as the linewidth of the loop decreases.

4. The antenna as recited in claim 1, wherein the impedance is controlled based on a characteristic that the imaginary number part of the impedance in the antenna is varied according to an internal area of the loop.

5. The antenna as recited in claim 4, wherein the impedance is controlled based on a characteristic that the imaginary number part increases as the internal area of the loop increases.

6. The antenna as recited in claim 1, wherein the impedance is controlled based on a characteristic that the real number part of the impedance in the antenna is varied according to a distance between the resonator and the loop.

7. The antenna as recited in claim 6, wherein the impedance is controlled based on a characteristic that the real number part decreases as the distance between the resonator and the loop increases.

8. The antenna as recited in claim 1, wherein the impedance is controlled based on a characteristic that the real number part of the impedance in the antenna is varied according to height of a loop side which is close to the resonator.

9. The antenna as recited in claim 8, wherein the impedance is controlled based on a characteristic that the real number part increases as the height of the loop side increases.

10. The antenna as recited in claim 2, wherein the imaginary number part is an inductive reactance.

11. The antenna as recited in c1aim 1, wherein the loop is a polygon.

12. The antenna as recited in claim 1, wherein the loop is a curve including a circle.

13. The antenna as recited in claim 1, wherein the resonator has a trapezoidal flat dipole structure with the opposed first and second ends, the first meander structure coupled to the first end, and the second meander structure coupled to the second end.

14. The antenna as recited in claim 1, wherein the impedance is controlled based on a characteristic that the impedance of the antenna is varied as a connecting position of the resonator and the feeder, i.e., a feed point, is varied.

15. The antenna as recited in claim 1, wherein the resonator and the feeder are open by a Direct Current (DC) method.

16. The antenna as recited in claim 15, wherein the resonator and the feeder are fabricated on a same side of one substrate.

17. The antenna as recited in claim 15, wherein the resonator and the feeder are individually fabricated on different sides of one substrate.

18. The antenna as recited in claim 15, wherein the resonator and the feeder are individually fabricated on different substrates.

19. The antenna as recited in claim 1, wherein the middle part of the resonator has a trapezoid flat dipole structure and both ends of the resonator have a meander structure.

20. The antenna as recited in claim 1, wherein the impedance is controlled based on a characteristic that the real number part of the impedance in the antenna is varied according to mutual inductance between the resonator and the feeder.

21. The antenna as recited in claim 20, wherein the impedance is controlled based on a characteristic that the real number part increases as the inductance between the resonator and the feeder increases.

22. The antenna as recited in claim 1, wherein the impedance is controlled based on a characteristic that the real number part of the impedance in the antenna is varied according to resistance of the resonator.

23. The antenna as recited in claim 22, wherein the impedance is controlled based on a characteristic that the real number part decreases as the resistance increases.

24. The antenna as recited in claim 1, wherein the impedance is controlled based on a characteristic that the imaginary number part of the impedance in the antenna is varied according to controlling inductance of the feeder.

25. The antenna as recited in claim 24, wherein the impedance is controlled based on a characteristic that the imaginary number part increases as the feeder inductance increases.

26. An impedance matching method of an antenna, the antenna comprising:

a resonator for determining a resonance frequency; and a feeder for providing an RF signal in a loop structure, wherein a characteristic that the imaginary number part of impedance in the antenna is varied according to the linewidth of the loop being used, wherein the resonator has a dipole structure with opposed first and second ends, a first meander structure coupled to the first end, and a second meander structure coupled to the second end, wherein the feeder has a loop structure that a terminal, connected to the element, is formed onto, and at least a distance between the dipole structure of the resonator and the loop structure of the feeder is varied to control a real number part of the antenna impedance, and wherein a internal circumference of the loop is less than 30% of a wavelength corresponding to a resonance frequency of the resonator.

27. The method as recited in claim 26, wherein a characteristic that the imaginary number part of the impedance in the antenna is varied according to internal area of the loop is used.

28. The method as recited in claim 27, wherein the characteristic that the real number part of the impedance in the antenna is varied according to distance between the resonator and the loop is used.

29. The method as recited in claim 28, wherein the characteristic that the real number part of the impedance in the antenna is varied according to length of the loop side close to the resonator is used.

* * * * *